United States Patent [19]

Kuhling

[11] 3,988,846

[45] Nov. 2, 1976

[54] FRAME FOR PICTURES OR THE LIKE

[76] Inventor: Monika Kuhling, Friedrichstrasse 37, 6200 Wiesbaden, Germany

[22] Filed: Jan. 16, 1975

[21] Appl. No.: 541,396

[30] Foreign Application Priority Data

Jan. 22, 1974 Germany ..... 2402941
Dec. 10, 1974 Germany ..... 2458463

[52] U.S. Cl. ..... 40/152.1; 40/156
[51] Int. Cl.[2] ..... G09F 1/12
[58] Field of Search ..... 40/152, 152.1, 156, 40/20 A

[56] References Cited

UNITED STATES PATENTS

| | | | |
|---|---|---|---|
| 1,692,999 | 11/1928 | Siegel | 40/156 |
| 2,614,354 | 10/1952 | Winslow | 40/156 |
| 2,791,051 | 5/1957 | Scheyer | 40/152.1 |
| 2,826,843 | 3/1958 | Fabry | 40/152 |
| 3,445,151 | 5/1969 | Stefanakis | 40/156 |
| 3,579,886 | 5/1971 | Hughes | 40/152 |
| 3,606,338 | 9/1971 | Cannata | 40/156 |
| 3,694,947 | 10/1972 | Mukai | 40/152 |
| 3,771,244 | 11/1973 | Ebner | 40/152 |

*Primary Examiner*—Louis G. Mancene
*Assistant Examiner*—Wenceslao J. Contreras
*Attorney, Agent, or Firm*—Edward J. Brenner

[57] ABSTRACT

A picture frame is formed of a transparent front box with rearward projecting rims. Complementary rims on an inner box fit tightly within the rims of the outer box. A downward flap on a rearward edge of an upper rim of the front box holds an upper rim of an inner box and engages a support. Outer sides of U-shaped rims of an inner box engage the rearward rims of the outer box; inner sides are sloped to engage supports. Clamps extend from rims of an inner box into inward cavities in rims of the front box.

2 Claims, 4 Drawing Figures

FRAME FOR PICTURES OR THE LIKE

BACKGROUND OF THE INVENTION

The invention concerns a frame for pictures or the like, with a transparent front box designed as a box cover with a rim all around. A back wall is placed behind the front box and fits into the box cover. Between the faces of front part and back wall the picture is held.

A construction of this type is known in German Design 6,917,904. In the case of that design patent, the picture is pressed by a back wall against the front part. The back wall is held by a spring-tape, which presses against the rim of the front part. Due to the fact that the tape is permanently extended by its tension, the tension is somehow an instability factor, because the tape can be dislocated from the rim very easily, when the tape is not placed very correctly along the rim, or if the frame is shocked. The tape has to be placed very carefully to prevent its sudden dislocation due to its inherent tension, thereby hurting the person who is handling the frame or damaging objects placed nearby. The spring tape has to be fixed in such a way that it cannot be dislocated during the transporting to the place where the frame is to be hung.

SUMMARY OF THE INVENTION

It is an aim of this invention to create a frame which is constructed of simple elements, and which enables a quick and easy change of pictures. In doing so, it should not be obvious that the picture is being held by a frame; however, the picture should be housed dustproof. The invention solves this problem in that the back is also designed as a box cover, which fits into the front box. The whole front box is produced in transparent material.

The frame consists of two very simply designed parts. Each is a box-type construction similar to box covers. One box cover fits into the other, and the rims of both boxes are so close together that dust cannot penetrate between them into the area where the picture is held. The picture fills up the entire front area, so that the front part of the inner box will be totally covered. The rim around all sides of the front part faces the wall on which the frame will be fixed, so that when looking directly at the picture, it gives the impression of being frameless which, of course, is what is required for modern art.

The invention can be used in galleries and museums; it is suitable for home use.

It is appropriate also to form the back wall with a rim all around. With this rim the back wall is stabilized and, therefore, does not sag or bend. However, it is pointed out that, if the inner box is made of material with sufficient rigidity, it would be acceptable to have at the back wall only two rims, one opposite the other.

Proceeding on the assumption that the rim of the inner box does not surmount the rim of the outer box, the rim of the outer box determines the distance between the frame and the wall. In this connection, the distance between the wall and the picture can be emphasized if, for example, the rim of the inner box appears metallic and, in this case, the whole inner box can be made of aluminium sheet. On the other hand, it is also possible to intensify the effect of the presentation of the picture without showing the rims by producing the whole inner box of transparent material. In this case, the transparent rims of the inner and outer boxes are close together, and the presentation of the picture therefore is especially effective.

There are different means of holding together inner and outer cases. On the one hand, it is possible to give inner and outer boxes such a form that both boxes hold together only if one is put into the other. Here it has to be taken into consideration also that, if the frame is fixed to a wall, the inner box - under the effect of its own weight — together with the outer box, is pressed against the wall, so that the inner box cannot fall out of the outer box. On the other hand, it is also possible to hold inner and outer boxes together with some type of clamp element, which presses against the rims. When using such clamp elements, it is not important that the inner and outer boxes fit in exactly, because the clamp elements hold both boxes together. The clamp elements direct their force against the rims in such a way that they are hardly visible. For example, it is possible to use as clamp elements, screws which are passed through the rims of the inner box, when they are tightened, press against the outer box rim. Furthermore, it is also possible to use locking elements. For example, spring-clamped plugs, which are passed inside through the rims of the inner box and which are pressed through the clearance in the rims of the outer box. Finally, it is also possible to use small pins which are passed through both rims in a vertical direction.

Additionally, it is appropriate to design the top rim of the outer case as a support, so that it is possible to hang the frame on a hook with such a support. For this purpose, the top rim of the outer case is folded inward, i.e., turned down behind the front rim as a flap. The flap which has been formed in this way can be simultaneously used to hold the back wall, because it overlaps the inner box. In this case, it is appropriate to install the clamp elements opposite the rim with the flap which holds together the front part and the back wall. To put both parts together, first the back wall has to be removed behind the flap and it can then be pressed into the front part. In doing so, the rims of the front part and back wall — opposite the side with the flap — will be placed one upon the other and finally will be held together by clamps which are installed therein.

To make possible safer hanging of the frame on its rim, the shaping of which has to be simple, bearing in mind the manufacturing tools, one can advantageously design the back wall in the shape of a "U", whereby the sides of the "U" are directed to the front box, the outer side of the "U" is in contact with the rim of the front part, and the inner side runs oblique in such a way that the horizontal clearance between the opposite rims is wider at the end of the sides than at the connection of the two sides of the "U".

To guarantee that the front box and the back wall hold safely together, it is useful to design the rim of the front box and the back wall in such a way, that the outer side of the "U" has nobs which snap into complementary cavities in the rim of the front box.

The front part and the back wall can be formed out of thin material, or both can be produced by pressing or injection moulding, in particular, if the front part and the back wall are made of transparent material.

DETAILED DESCRIPTION OF THE DRAWING

Figure 1:
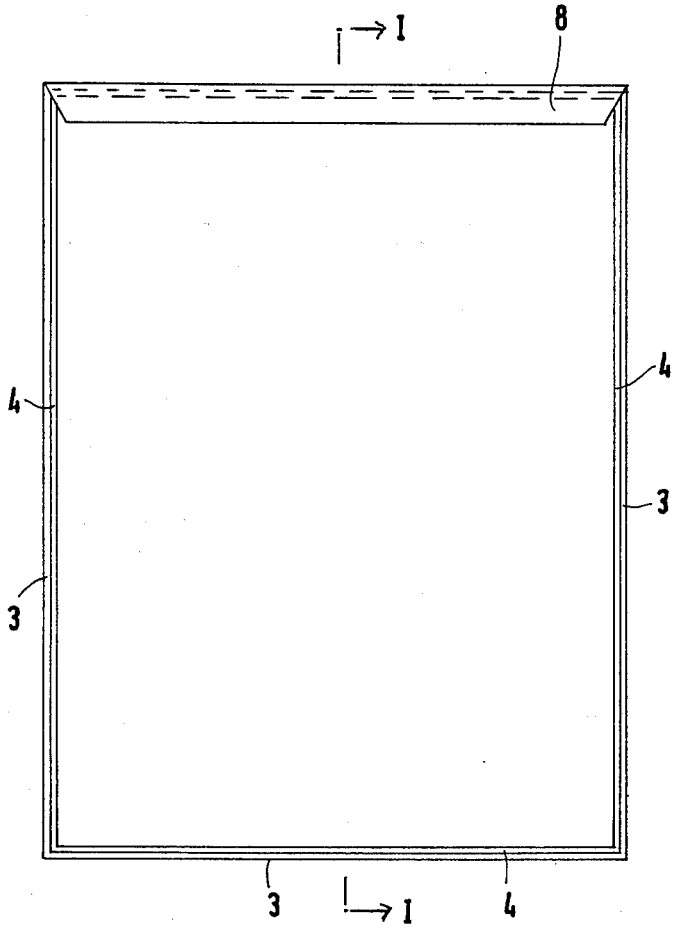
FIG. 1 shows the frame shown from the rear.
Figure 2:
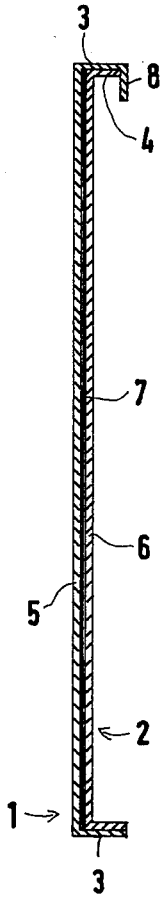
FIG. 2 is a sectional view taken on line I—I of FIG. 1.

Referring to FIG. 1, which shows the back view of a frame, and FIG. 2, which shows a sectional view of FIG. 1 along line I—I, the frame consists of front part 1 and back wall 2, both formed as a box cover. Both front part 1 and back wall 2 have rims 3 and 4 which are folded back all around. Within rims 3 and 4 are face area 5 of front part 1 and face area 6 of back wall 2. Rims 3 and 4, in this case, are right-angled to faces 5 and 6. With regard to the inside and outside dimensions, rims 3 and 4 are so formed that back wall 2 fits exactly into front part 1, and, because of their formation, both parts are held together. Picture 7 is placed between faces 5 and 6. Shown as a line in FIG. 1, picture 7, looked on from the front part of frame 5, is clearly visible, because front part 1 is made of transparent material.

Rims 3 and 4 also can be placed on a slant to surfaces 5 and 6 in the form of a pyramid, bearing in mind that, in that case, rims 3 and 4 must be tight together.

Flap 8 is placed parallel to front surface 5 on upper rim 3. This flap is directed behind rim 4 of back wall 2 to hold back wall 2 in place. The flap can also be used as a support by which the frame can be affixed to a wall, either on hooks or on strips.

Figure 3:
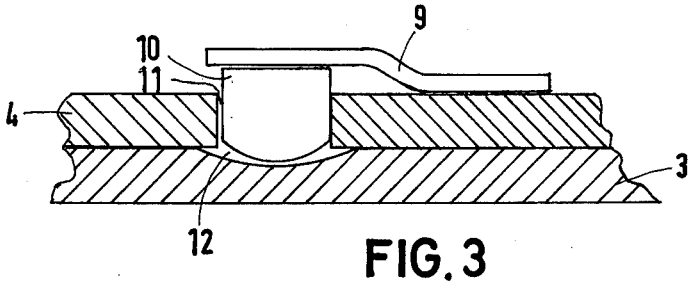
FIG. 3 is a sectional sketch of a clamp element.

It is also possible to hold front part 1 and back wall 2 together by clamp elements which are directed toward rims 3 and 4. An example of this construction is shown in FIG. 3. In this example, on rim 4 of back wall 2 plug 10 with a spherical surface is spring-clamped. Plug 10 passes through hole 11 in rim 4, to snap into depression 12, which is in rim 3. When front part 1 or back wall 2 are put together or dismantled, plug 10 is disengaged or pushed out of depression 12.

When the frame has flap 8, such a clamp element must be placed opposite the flap to hold it in place. However, it is also possible — especially when the frame has no flap to place such clamp elements at the vertical parts of rims 3 and 4 and, particularly with those of larger sizes, it is useful to install several clamp elements.

It is also possible to use spring-loaded balls or nobs which are pressed against the opposite rim to clamp front part 1 and back wall 2 together; this effect can be intensified by having depressions in the opposite rim.

Figure 4:
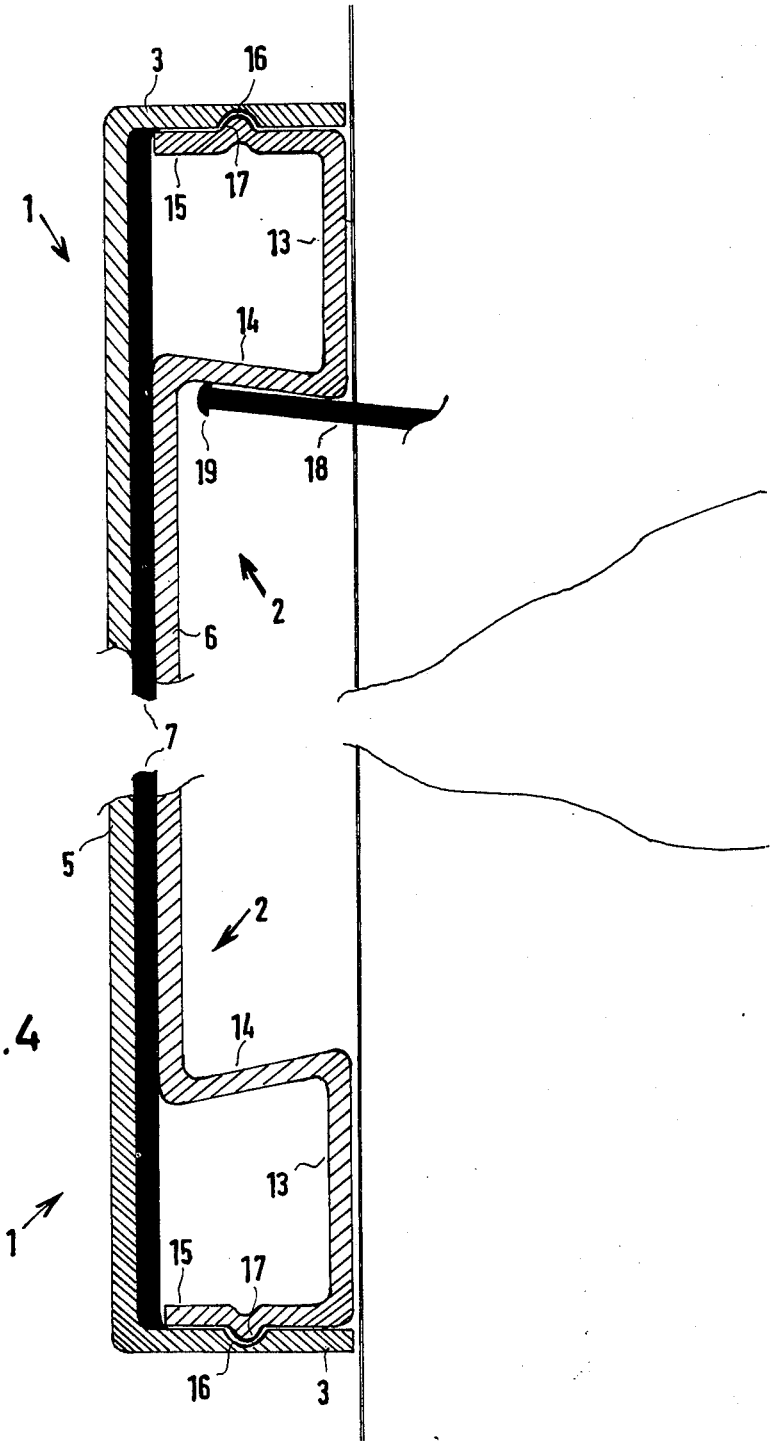
FIG. 4 is a sectional view of a frame with a U-shaped rim of the back wall.

The frame illustrated in FIG. 4 consists of front part 1 and back wall 2, each in box-type construction. Each part — front part 1 and back wall 2 — has a rim 3 and 13 respectively, all around. Picture 7 is placed between front part 1 and back wall 2. If looked on from the front part of the frame, picture 7 is clearly visible because front part 1 is made of transparent material.

Back wall 2 is provided with a U-shaped rim 13 having an inner side 14 and an outer side 15. Back wall 2 is adapted to fit snuggly into front part 1 with outer side 15 of U-shaped rim 13 being in close contact with rim 3 of front part 1 and with the open side of U-shaped rim 13 being directed toward front part 1.

To guarantee that front part 1 and back wall 2 hold together very safely, outer side 15 of the "U" has nobs 17 which fit in cavities 16 of rim 3. Nobs 17 and cavities 16 are arranged opposite each other, so that a picture 7 placed between front part 1 and back wall 2 is gently pressed against front part 1.

The described "U"-shaped rim 13 of back wall 2 allows that the edge of back wall 2 can be pressed without needing any tools.

As shown, side 14 runs slightly obliquely in such a way that the horizontal clearance between two opposite sides 14 is wider on the base of back wall 2 than at the stage where sides 14 and 15 are connected. If the frame is hooked on a nail 18, the frame has therefore the tendency to place itself with its side 14 behind head 19 of nail 18. The slant of side 14 prevents the frame from sliding down nail 18.

To change a picture, it is only necessary to push out front part 1 from the back wall 2, so that the picture is accessible and can be replaced by another one.

Especially, if the frame is made completely of synthetic plastic material, it is very light and can, therefore, be held by relatively weak hooks. At least front part 1 consists of transparent material. It is expedient to produce also back wall 2 of transparent material. However, the back wall can be made of any other rigid material.

While the invention has been described with reference to specific embodiments, it will be obvious to those skilled in the art that modifications and variations of the invention may be constructed without departing from the spirit and scope of the invention. The scope of the invention is defined in the following claims.

What is claimed is:

1. A frame for pictures and the like comprising
   a front part of transparent flexible synthetic plastic material designed as a box cover having a face with an extending rim, and
   a back part of flexible synthetic plastic material designed as a box cover having a face with a U-shaped rim having an inner side and outer side, the inner side of the U-shaped rim running obliquely in such a way that the clearance between the opposite sides is wider at the ends of the sides than at a connection of the two sides of the U-shaped rim whereby said frame may be hooked on a nail on a wall,
   said back part of said frame being adapted to fit snuggly into the front part and to hold said picture between the respective faces thereof with the U-shaped rim of said back part being directed toward the front part and with the outer side of the U-shaped rim being in contact with the rim of the front part, whereby said flexible front and back parts may be simply snapped together to mount a picture and yet readily separated to remove said picture.

2. A frame according to claim 1, wherein the outer side of the U-shaped rim has nobs which snap into cavities, which are opposite to them in the rim of the front part.

* * * * *